US007477750B2

(12) United States Patent
Yoshino

(10) Patent No.: US 7,477,750 B2
(45) Date of Patent: Jan. 13, 2009

(54) SIGNAL DELAY TIME MEASUREMENT DEVICE AND COMPUTER PROGRAM THEREFOR

(75) Inventor: Hajime Yoshino, Saitama (JP)

(73) Assignee: Pioneer Corporation, Tokyo (JP)

( * ) Notice: Subject to any disclaimer, the term of this patent is extended or adjusted under 35 U.S.C. 154(b) by 993 days.

(21) Appl. No.: 10/991,546

(22) Filed: Nov. 19, 2004

(65) Prior Publication Data

US 2005/0129255 A1 Jun. 16, 2005

(30) Foreign Application Priority Data

Nov. 19, 2003 (JP) ..... 2003-389027

(51) Int. Cl.
*H04R 29/00* (2006.01)
*H04R 3/00* (2006.01)

(52) U.S. Cl. ..... 381/59; 381/96; 702/79

(58) Field of Classification Search ..... 381/56–59, 381/95, 96, 61, 63, 91, 122; 702/57, 59; 73/579, 586, 587, 602, 645
See application file for complete search history.

(56) References Cited

U.S. PATENT DOCUMENTS 5,123,286 A * 6/1992 Baumgartner ..... 73/861.27
6,655,212 B2 * 12/2003 Ohta ..... 73/586
7,054,448 B2 * 5/2006 Yoshino et al. ..... 381/59
7,260,227 B2 * 8/2007 Higashihara et al. ..... 381/56
2005/0033537 A1 * 2/2005 Szajnowski ..... 702/79
2006/0247875 A1 * 11/2006 Ooshima ..... 702/79
2007/0086597 A1 * 4/2007 Kino ..... 381/59

FOREIGN PATENT DOCUMENTS

EP 0 642 292 A2 3/1995
EP 1 253 805 A2 10/2002
JP 2002-330499 11/2002

* cited by examiner

*Primary Examiner*—Xu Mei
(74) *Attorney, Agent, or Firm*—Young & Thompson

(57) ABSTRACT

A signal delay time measurement device outputs, to a sound space, a measurement signal sound corresponding to a measurement signal such as a pulse signal, and obtains a response signal indicating a response thereof. By comparing the response signal with a predetermined threshold, the signal delay time measurement device measures a signal delay time in the sound space. The signal delay time in the above-mentioned sound space includes a delay time other than the delay time caused by a transmission of a signal sound to the sound space, and the response signal cannot theoretically reach the signal delay amount calculating unit during the delay time. Therefore, the delay time calculating unit does not perform the comparison in a no-response period in which the response signal has not reached the delay time calculating unit yet. Thereby, it can be prevented that the signal delay time is erroneously calculated by an effect of a background noise during the no-response period.

10 Claims, 12 Drawing Sheets

SIGNAL DELAY TIME MEASUREMENT DEVICE AND COMPUTER PROGRAM THEREFOR

BACKGROUND OF THE INVENTION

1. Field of the Invention

The present invention relates to a signal delay time measurement device which measures a signal delay time in a sound space in an audio system including a plurality of speakers.

2. Description of Related Art

For an audio system having a plurality of speakers to provide a high quality sound space, it is required to automatically create an appropriate sound space with much presence. In other words, it is required for the audio system to automatically correct sound field characteristics because it is quite difficult for a listener to appropriately adjust the phase characteristic, the frequency characteristic, the sound pressure level and the like of sound reproduced by a plurality of speakers by manually manipulating the audio system by himself to obtain appropriate sound space.

So far, as this kind of automatic sound field correcting system, there is known a system disclosed in Japanese Patent Application Laid-open under No. 2002-330499. In this system, for each signal transmission path corresponding to plural channels, a test signal outputted from a speaker is collected, and a frequency characteristic thereof is analyzed. Then, by setting coefficients of an equalizer provided on the signal transmission path, each signal transmission path is corrected to have a desired frequency characteristic.

In addition, a signal delay time of each signal transmission path corresponding to plural channels is measured, and a signal delay characteristic on each signal transmission path is adjusted. In a normal signal delay time measurement, when a processor in an automatic sound field correcting system outputs a measurement pulse, the processor simultaneously starts to receive a microphone input. A time period until a level of the microphone input first becomes larger than a predetermined threshold is determined as the signal delay time.

However, by a background noise in an environment to which a system is set, the background noise level may become larger than the threshold before an actual response of a measurement pulse reaches the processor, and it is problematic that the signal delay time shorter than the actual signal delay time is erroneously measured.

In that point, for preventing the error from occurring to the determination due to an effect of the background noise, there is proposed a technique for preventing an erroneous determination due to the background noise by measuring the level of the background noise in advance and setting the threshold to a level a little higher than the level of the background noise.

However, even if the technique is adopted, when a signal delay time of a certain channel is actually measured, the level of the background noise may become higher than the level of the background noise measured in advance. Therefore, the erroneous determination cannot often be prevented.

SUMMARY OF THE INVENTION

The present invention has been achieved in order to solve the above problems. It is an object of this invention to provide a signal delay time measurement device capable of excluding an effect of a background noise and performing an accurate measurement of a signal delay time.

According to one aspect of the present invention, there is provided a signal delay time measurement device which measures a signal delay time in a sound space, including: a measurement signal output unit which outputs a measurement signal; a signal sound output unit which outputs a measurement signal sound corresponding to the measurement signal to the sound space; a response detecting unit which outputs a response signal indicating a response of the sound space to the measurement signal sound; and a delay time calculating unit which performs a comparison between the response signal and a predetermined threshold to calculate the signal delay time, wherein the delay time calculating unit does not perform the comparison in a no-response period in which the response signal has not reached the delay time calculating unit yet.

The above signal delay time measurement device outputs the measurement signal sound corresponding to the measurement signal such as a pulse signal to the sound space, and obtains the response signal indicating the response. By comparing the response signal with the predetermined threshold, the signal delay time measurement device measures the signal delay time in the above-mentioned sound space. The signal delay time in the above-mentioned sound space includes the delay time other than the delay time caused by the transmission of the signal sound in the sound space, and the response signal cannot theoretically reach the signal delay amount calculating unit during the delay time. Therefore, the delay time calculating unit does not perform the comparison in the no-response period in which the response signal has not reached the delay time calculating unit yet. Thereby, it can be prevented that the signal delay time is erroneously calculated by the effect of the background noise during the no-response period.

According to another aspect of the present invention, there is provided a signal delay time measurement device which measures a signal delay time in a sound space, including: a measurement signal output unit which outputs a measurement signal; a signal sound output unit which outputs a measurement signal sound corresponding to the measurement signal to the sound space; a response detecting unit which outputs a response signal indicating a response of the sound space to the measurement signal sound; a delay time calculating unit which performs a comparison between the response signal and a predetermined threshold to calculate the signal delay time; and a threshold determining unit which measures a background noise in the sound space during a background noise measurement period and determines the predetermined threshold based on a measurement result before each signal delay time is calculated, wherein the background noise measurement period includes a no-response period in which the response signal has not reached the delay time calculating unit yet.

The above signal delay time measurement device outputs, to the sound space, the measurement signal sound corresponding to the measurement signal such as the pulse signal, and obtains the response signal indicating the response. By comparing the response signal with the predetermined threshold, the signal delay time measurement device measures the signal delay time in the above-mentioned sound space. The threshold is determined based on the background noise level in the sound space. The signal delay time in the above sound space includes the delay time other than the delay time caused by the transmission of the signal sound to the sound space, and the response signal cannot theoretically reach the signal delay amount calculating unit during the period. Namely, during the period, the background noise level in the sound space immediately before the actual signal delay time calculating process can be obtained. Therefore, the threshold determining unit sets the background noise measurement period to include the no-response period in which the response signal has not reached the delay time calculating unit yet, and the threshold is determined based on the measurement result of the background noise in the period. Thereby, since the threshold is determined based on the background noise obtained immediately before the actual signal delay time, it becomes possible to more accurately calculate the signal delay time.

In a manner of the above-mentioned signal delay time measurement device, the no-response period may correspond to an in-device delay time which is caused by a processing of the measurement signal and the response signal in the signal delay time measurement device. Since the above-mentioned signal delay time includes the sound delay time in the sound space and the in-device delay time caused by the processing of the measurement signal and the response signal in the measurement device, the no-response period can be prescribed as an in-device delay period.

In another manner, the signal delay time measurement device may further include a storage unit which stores the in-device delay time as a fixed value, and the no-response period may be set to a period of the in-device delay time from an output of the measurement signal. By storing the in-device delay time as the fixed value, it becomes possible to rapidly perform the measurement of the signal delay time.

In still another manner, the background noise measurement period may include a predetermined period before the measurement signal output unit outputs the measurement signal. Like this, by extending the background noise measurement period, it becomes possible to measure the variation of the background noise in a short time as much as possible to determine an effective threshold.

According to another aspect of the present invention, there is provided a computer program executed on a computer which makes the computer function as a signal delay time measurement device including: a measurement signal output unit which outputs a measurement signal; a signal sound output unit which outputs a measurement signal sound corresponding to the measurement signal to a sound space; a response detecting unit which outputs a response signal indicating a response of the sound space to the measurement signal sound; and a delay time calculating unit which performs a comparison between the response signal and a predetermined threshold to calculate a signal delay time in the sound space. The above-mentioned delay time calculating unit does not perform the comparison in the no-response period in which the response signal has not reached the delay time calculating unit yet.

According to another aspect of the present invention, there is provided a computer program executed on a computer which makes the computer function as a signal delay time measurement device including: a measurement signal output unit which outputs a measurement signal; a signal sound output unit which outputs a measurement signal sound corresponding to the measurement signal to a sound space; a response detecting unit which outputs a response signal indicating a response of the sound space to the measurement signal sound; a delay time calculating unit which performs a comparison between the response signal and a predetermined threshold and calculates a signal delay time in the sound space; a threshold determining unit which measures a background noise in the sound space in a background noise measurement period and determines the predetermined threshold based on a measurement result before each signal delay time is calculated. The background noise measurement period includes the no-response period in which the response signal has not reached the delay time calculating unit yet.

By executing the computer program for the signal delay time measurement on the computer, the signal delay time measurement device can be realized.

According to another aspect of the present invention, there is provided a signal delay time measurement method which measures a signal delay time in a sound space, including: a measurement signal output process which outputs a measurement signal; a signal sound output process which outputs a measurement signal sound corresponding to the measurement signal to the sound space; a response detecting process which outputs a response signal indicating a response of the sound space to the measurement signal sound; and a delay time calculating process which performs a comparison between the response signal and a predetermined threshold to calculate the signal delay time by a delay time calculating unit, wherein the delay time calculating process does not perform the comparison in a no-response period in which the response signal has not reached the delay time calculating unit yet.

According to still another aspect of the present invention, there is provided a signal delay time measurement method which measures a signal delay time in a sound space, including; a measurement signal output process which outputs a measurement signal; a signal sound output process which outputs a measurement signal sound corresponding to the measurement signal to the sound space; a response detecting process which outputs a response signal indicating a response of the sound space to the measurement signal sound; a delay time calculating process which performs a comparison between the response signal and a predetermined threshold to calculate the signal delay time by a delay time calculating unit; and a threshold determining process which measures a background noise in the sound space in a background noise measurement period and determines the predetermined threshold based on a measurement result before each signal delay time is calculated, wherein the background noise measurement period includes a no-response period in which the response signal has not reached the delay time calculating unit yet.

By the above-mentioned signal delay time measurement method, the signal delay time can accurately be calculated with eliminating the effect of the background noise during the no-response period.

The nature, utility, and further features of this invention will be more clearly apparent from the following detailed description with respect to preferred embodiment of the invention when read in conjunction with the accompanying drawings briefly described below.

DETAILED DESCRIPTION OF THE PREFERRED EMBODIMENTS

The preferred embodiments of the present invention will now be described below with reference to the attached drawings.

[Basic Principle]

Figure 1A:
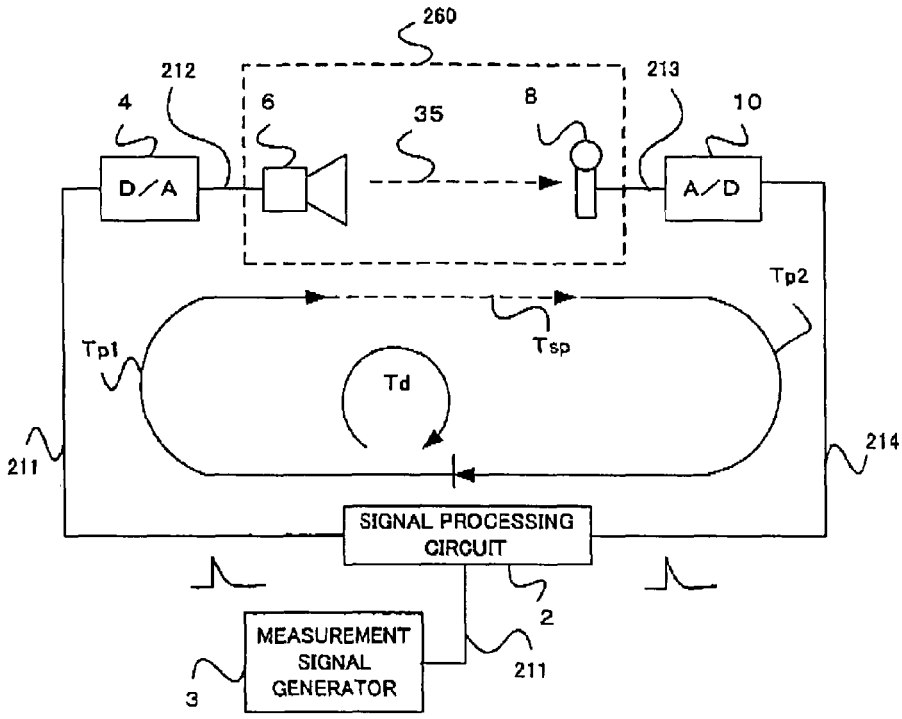
FIGS. 1A and 1B are block diagrams schematically showing basic configurations for a signal delay time measurement.

First, the description will be given of a basic principle of a signal delay time measurement according to the present invention. FIG. 1A schematically shows the basic configuration for the signal delay time measurement. As shown in FIG. 1A, the signal delay time measurement device includes a signal processing circuit 2, a measurement signal generator 3, a D/A converter 4, a speaker 6, a microphone 8 and an A/D converter 10. The speaker 6 and the microphone 8 are disposed in a sound space 260. It is noted that the sound space 260 may be a listening room, a home theater and the like, for example.

The measurement signal generator 3 generates the pulse signal (hereafter, referred to as "measurement pulse signal") as a measurement signal 211, and supplies it to the signal processing circuit 2. The measurement pulse signal can be stored in a memory in the measurement signal generator 3 as a digital signal. The signal processing circuit 2 transmits the measurement pulse signal 211 to the D/A converter 4. The D/A converter 4 converts the measurement pulse signal 211 to an analog measurement pulse signal 212, and supplies it to the speaker 6. The speaker 6 outputs a measurement pulse sound 35 corresponding to the measurement pulse signal 212 to the sound space 260 as the measurement signal sound.

The microphone 8 collects the measurement pulse sound 35 in the sound space 260, and transmits it to the A/D converter 10 as an analog response signal 213. The response signal 213 includes a response component of the sound space 260 to the measurement pulse signal 35. The A/D converter 10 converts the response signal 213 to a digital response signal 214, and supplies it to the signal processing circuit 2. The signal processing circuit 2 calculates a signal delay time Td in the sound space 260 by comparing the response signal 214 with a predetermined threshold.

As understood from FIG. 1A, the signal delay time Td measured by the signal processing circuit 2 is a sum of a sound delay time Tsp in the sound space and a delay time (mainly, a delay time in the delay time measurement device, and hereafter referred to as "in-device delay time Tp") other than the sound delay time Tsp. The sound delay time Tsp is a delay time from outputting of the measurement pulse sound 35 from the speaker 6 until receiving of it by the microphone 8 in the sound space 260. On the contrary, the in-device delay time Tp includes a delay time Tp1 on an output side of the measurement pulse sound and a delay time Tp2 on an input side of the response signal 8. The delay time Tp1 on the output side of the measurement pulse sound includes a time in which the measurement pulse sound 211 is transmitted from the signal processing circuit 2 to the D/A converter 4, and a conversion processing time by the D/A converter 4. In addition, the delay time Tp2 on the input side of the response signal includes a conversion processing time of the response signal collected by the microphone 8 in the A/D converter 10, and a transmission time from the A/D converter 10 to the signal processing circuit 2.

Therefore, even if the sound delay time Tsp is zero (i.e., in a state that the speaker 6 and the microphone 8 are close to each other), since the in-device delay time Tp exists, the signal delay time Td does not become zero. In other words, in a period corresponding to the in-device delay time Tp from the timing at which the signal processing circuit 2 starts outputting the measurement pulse signal 211, the response signal 214 cannot theoretically reach the signal processing circuit 2. In that point, in the present invention, by assuming that the response signal cannot reach the signal processing circuit 2 in a period (hereafter, referred to as "no-response period") corresponding to the in-device delay time Tp after the outputting of the measurement pulse signal 211, a comparison with the threshold for calculating the signal delay time Td is not performed.

Figure 2A:
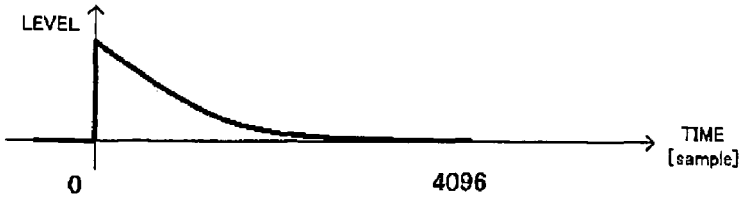
FIGS. 2A to 2F are waveforms for explaining a signal delay time measurement method.
Figure 2B:
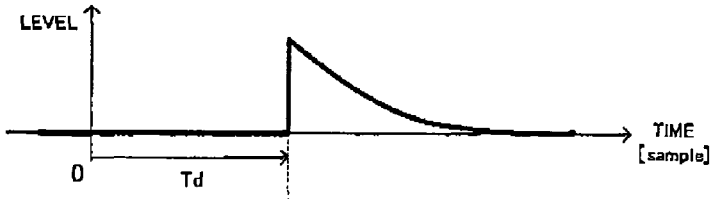
Figure 2C:
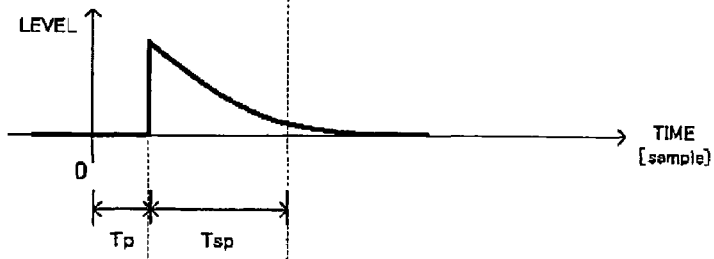

FIGS. 2A to 2C show waveform examples of the response signal 214 received by the signal processing circuit 2. FIG. 2A shows the waveform example of the response signal 214 in a case of assuming that the signal delay time Td is zero. The horizontal axis indicates time, which is indicated by a number of samples, because the response signal 214 is the digital signal. The vertical axis indicates a level of the response signal 214. At time 0, the signal processing circuit 2 outputs the measurement pulse signal 211. By assuming that the signal delay time Td is zero, as shown in FIG. 2A, the response signal 214 shows a waveform exponentially decreasing.

FIG. 2B shows a state of a general sound space, i.e., the response signal waveform in a case that the speaker and the microphone are located apart from each other by several meters in the sound space. The measurement pulse signal is outputted from the signal processing circuit 2 at the time 0. The response signal is inputted to the signal processing circuit 2 with the signal delay time Td.

FIG. 2C shows the response signal waveform in a case that the speaker and the microphone are disposed closely to each other in the sound space. Since the speaker and the microphone are close to each other, the sound delay time Tsp is zero, and the delay time of the response signal corresponds to the in-device delay time Tp. As shown in FIGS. 2B and 2C, the signal delay time Td in the normal state is a sum of the in-device delay time Tp and the sound delay time Tsp. In addition, the period of the in-device delay time Tp from the time 0 at which the signal processing circuit 2 outputs the measurement pulse signal is obviously the period in which the response of the measurement pulse sound cannot reach the signal processing circuit 2. Thus, in the present embodiment, the in-device delay time Tp is set to the above-mentioned no-response period, and the comparison processing of the response signal and the threshold for calculating the signal delay time Td is not executed in the no-response period.

Figure 1B:
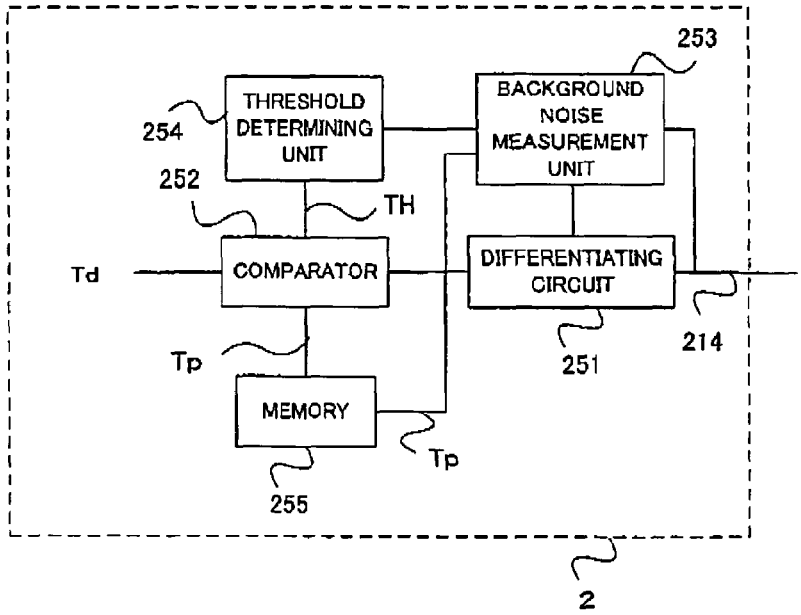

FIG. 1B shows a configuration related to a time delay measurement in the signal processing circuit 2. The response signal 214 inputted from the A/D converter 10 to the signal processing circuit 2 is inputted to a differentiating circuit 251. The differentiating circuit 251 differentiates the response signal 214, and calculates an absolute value (ABS) to supply it to a comparator 252.

A background noise measurement unit 253 detects a background noise level from the response signal 214 in a background noise measurement period Tm, which will be described later, and supplies a largest level value thereof to a threshold determining unit 254. The threshold determining unit 254 determines a threshold TH larger than the largest level value of the background noise by a predetermined value, and inputs it to the comparator 252.

A memory 255 stores the in-device delay time Tp, and inputs it to the comparator 252. The comparator 252 compares a differentiating signal of the response signal inputted from the differentiating circuit 251 with the threshold inputted from the threshold determining unit 254, and calculates the signal delay time Td. However, the comparator 252 does not perform the comparison processing of a differentiating value of the response signal and the threshold TH in the no-response period corresponding to the above-mentioned in-device delay time Tp from the timing at which the signal processing circuit 2 starts outputting the measurement signal 211, on the basis of the in-device delay time Tp supplied from the memory 255.

Figure 2D:
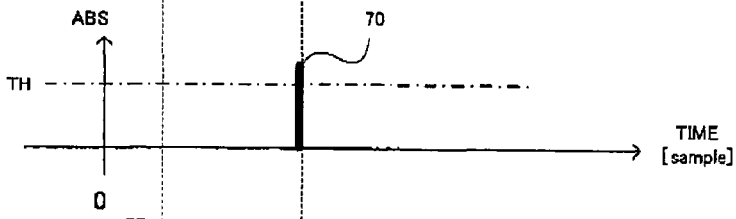
Figure 2E:
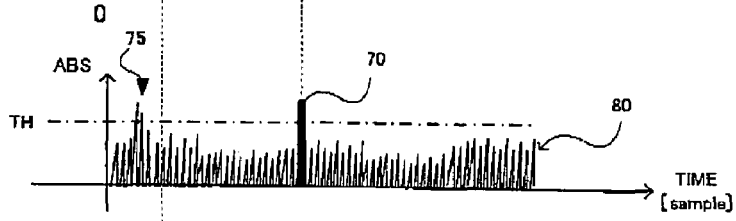
Figure 2F:
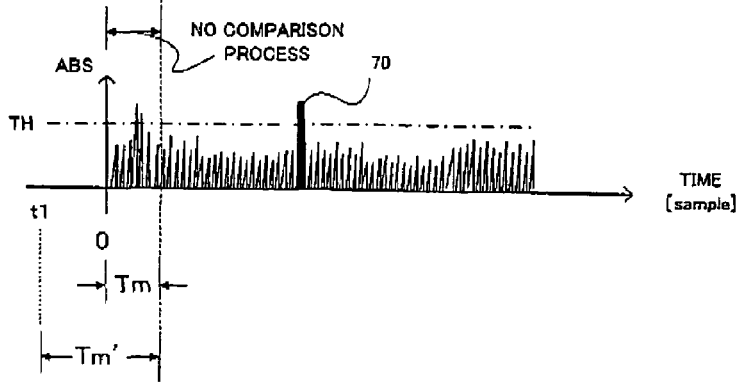

FIGS. 2D to 2F show states of the comparison processing in the comparator 252. FIG. 2D shows a waveform of the differentiating signal of the response signal outputted from the differentiating circuit 251. The horizontal axis indicates time, and the vertical axis indicates a differentiating value (absolute value: ABS). A differentiating waveform 70 appears at a rise-up time of the response signal waveform shown in FIG. 2B.

FIG. 2E is a diagram showing a waveform in which a waveform example of the background noise is added to the waveform diagram of FIG. 2D. As shown in FIG. 2E, if a background noise 80 includes a background noise component 75 larger than the threshold TH, the comparator 252 may erroneously regard it as the response signal 70. However, in the present invention, the in-device delay time Tp is set as the no-response period, as shown in FIG. 2E. Since the pulse 70 corresponding to the response signal cannot arrive in the no-response period, the comparator 252 does not execute the comparison processing. Therefore, even if the background noise component 75 larger than the threshold TH exists in the no-response period, it is avoided to erroneously regard it as the response signal.

Next, the description will be given of a measurement in the background noise measurement unit 253. As described above, the response of the measurement pulse sound cannot arrive during the period corresponding to the in-device delay time Tp from the timing at which the signal processing circuit 2 starts outputting the measurement pulse sound, and the response signal can arrive immediately after the period. Thus, since the background noise level immediately before the execution of the comparison processing of the response signal can be obtained in the period, the period can be quite preferred as a period for detecting the background noise level, which is used to determine the threshold TH. In the embodiment of the present invention, the background noise measurement unit 253 measures the background noise level in the period corresponding to the in-device delay time Tp from the time 0, and based on the level, the threshold determining unit 254 determines the threshold TH used by the comparator 252 in the comparison processing immediately after the measurement.

Concretely, as shown in FIG. 2F, the background noise measurement unit 253 receives the in-device delay time Tp from the memory 255, and sets the period corresponding to the in-device delay time Tp from the time 0 at which the signal processing circuit 2 starts outputting of the measurement pulse sound signal as a background noise measurement period Tm. The background noise measurement unit 253 measures the background noise in the background noise measurement period Tm, and supplies the largest level to the threshold determining unit 254. Thereby, by using the threshold determined based on the background noise level at every time of measuring the signal delay time, it becomes possible to accurately measure the signal delay time.

Though the background noise measurement period Tm is prescribed as the period corresponding to the in-device delay time Tp from the time 0 in the above example, the measurement of the background noise level may be started before the time 0. Namely, as shown in FIG. 2F, the background noise measurement period Tm may be started from a predetermined time t1 before the signal processing circuit 2 outputs the measurement pulse sound signal, and may be ended when the in-device delay time Tp passed from the time 0 (see period Tm'). Like this, by extending the background noise measurement period Tm, the measurement including an amount of variation in a short time of the background noise becomes possible, and the largest level of the background noise actually occurring in the sound space can be measured more accurately. However, since an inherent purpose is to detect the background noise level occurring immediately before the comparison processing of the response signal and determine the threshold used for the comparison processing immediately after the detection, the background noise measurement period Tm is determined to securely include the period corresponding to the in-device delay time Tp from the time 0.

[Automatic Sound Field Correcting System]

Next, the description will be given of an embodiment of the automatic sound field correcting system to which the present invention is applied, with reference to the attached drawings.

(I) System Configuration

Figure 3:
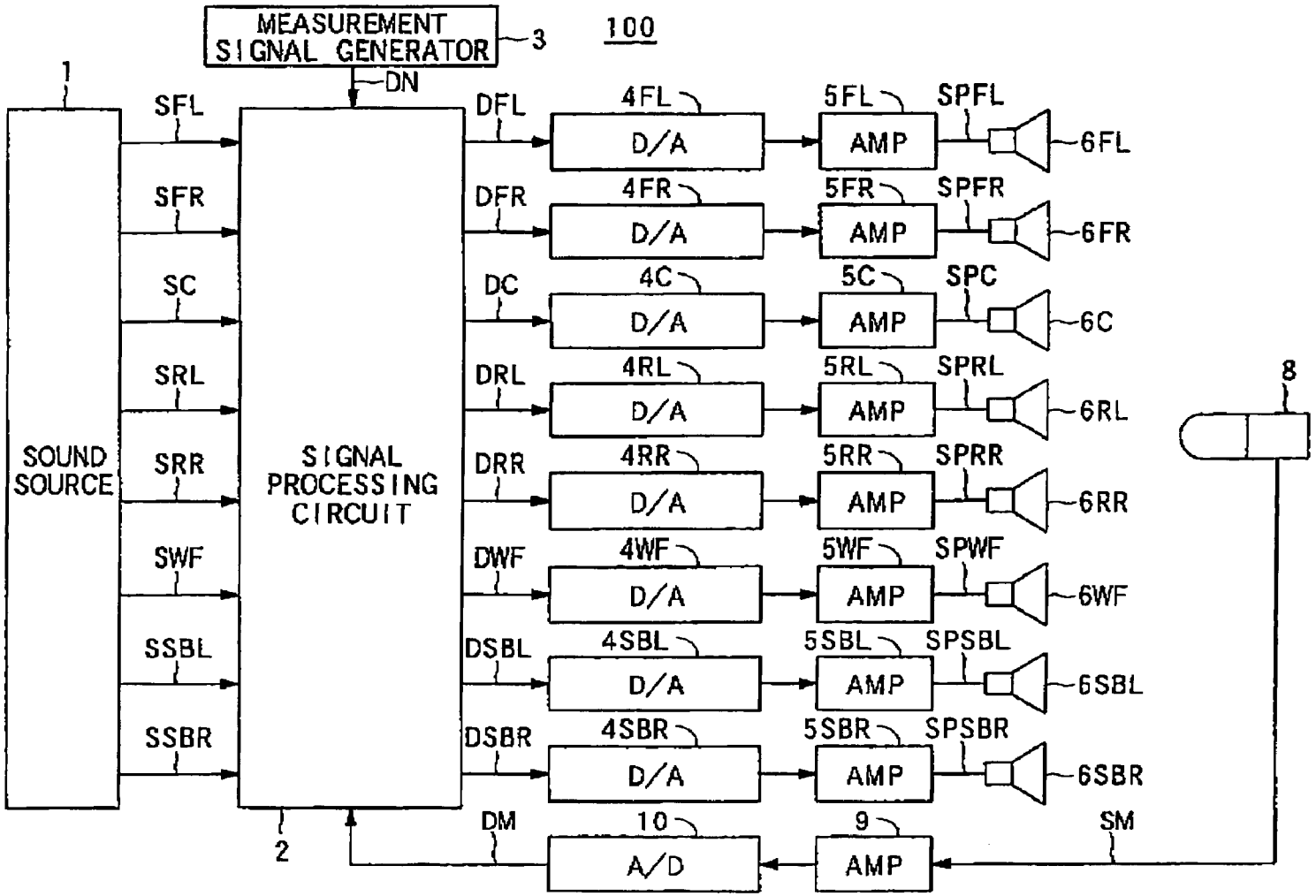
FIG. 3 is a block diagram showing a configuration of an audio system including an automatic sound field correcting system according to an embodiment of the present invention.

FIG. 3 is a block diagram showing a configuration of an audio system employing the automatic sound field correcting system of the present embodiment.

In FIG. 3, an audio system 100 includes a sound source 1 such as a CD (Compact Disc) player or a DVD (Digital Video Disc or Digital Versatile Disc) player, a signal processing circuit 2 to which the sound source 1 supplies digital audio signals SFL, SFR, SC, SRL, SRR, SWF, SSBL and SSBR via the multi-channel signal transmission paths, and a measurement signal generator 3.

While the audio system 100 includes the multi-channel signal transmission paths, the respective channels are referred to as "FL-channel", "FR-channel" and the like in the following description. In addition, the subscripts of the reference number are omitted to refer to all of the multiple channels when the signals or components are expressed. On the other hand, the subscript is put to the reference number when a particular channel or component is referred to. For example, the description "digital audio signals S" means the digital audio signals SFL to SSBR, and the description "digital audio signal SFL" means the digital audio signal of only the FL-channel.

Further, the audio system 100 includes D/A converters 4FL to 4SBR for converting the digital output signals DFL to DSBR of the respective channels processed by the signal processing by the signal processing circuit 2 into analog signals, and amplifiers 5FL to 5SBR for amplifying the respective analog audio signals outputted by the D/A converters 4FL to 4SBR. In this system, the analog audio signals SPFL to SPSBR after the amplification by the amplifiers 5FL to 5SBR are supplied to the multi-channel speakers 6FL to 6SBR positioned in a listening room 7, shown in FIG. 8 as an example, to output sounds.

The audio system 100 also includes a microphone 8 for collecting reproduced sounds at a listening position RV, an amplifier 9 for amplifying a collected sound signal SM outputted from the microphone 8, and an A/D converter 10 for converting the output of the amplifier 9 into a digital collected sound data DM to supply it to the signal processing circuit 2.

The audio system 100 activates full-band type speakers 6FL, 6FR, 6C, 6RL, 6RR having frequency characteristics capable of reproducing sound for substantially all audible frequency bands, a speaker 6WF having a frequency characteristic capable of reproducing only low-frequency sounds and surround speakers 6SBL and 6SBR positioned behind the listener, thereby creating sound field with presence around the listener at the listening position RV.

Figure 8:
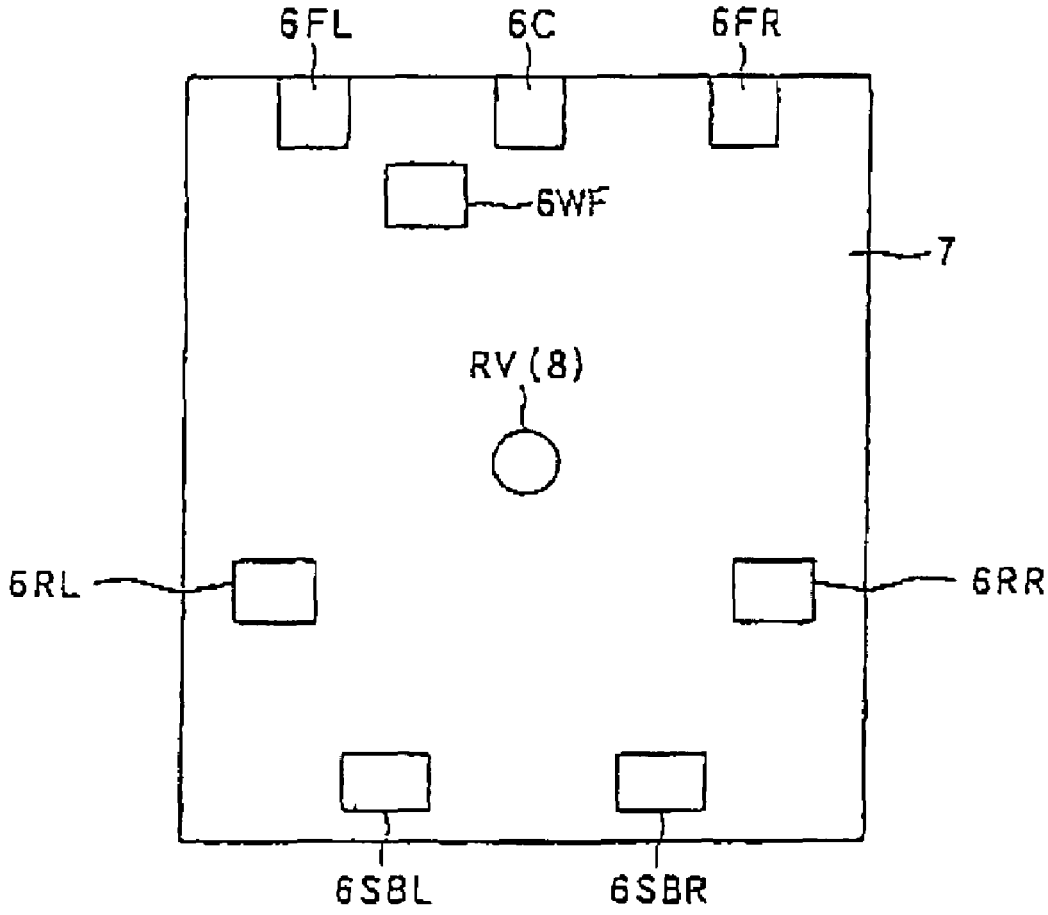
FIG. 8 is a diagram showing an example of speaker arrangement in a certain sound field environment.

With respect to the positions of the speakers, as shown in FIG. 8, for example, the listener places the two-channel, left and right speakers (a front-left speaker and a front-right speaker) 6FL, 6FR and a center speaker 6C, in front of the listening position RV, in accordance with the listener's taste. Also the listener places the two-channel, left and right speakers (a rear-left speaker and a rear-right speaker) 6RL, 6RR as well as two-channel, left and right surround speakers 6SBL, 6SBR behind the listening position RV, and further places the sub-woofer 6WF exclusively used for the reproduction of low-frequency sound at any position. The automatic sound field correcting system installed in the audio system 100 supplies the analog audio signals SPFL to SPSBR, for which the frequency characteristic, the signal level and the signal propagation delay characteristic for each channel are corrected, to those 8 speakers 6FL to 6SBR to output sounds, thereby creating sound field space with presence.

Figure 4:
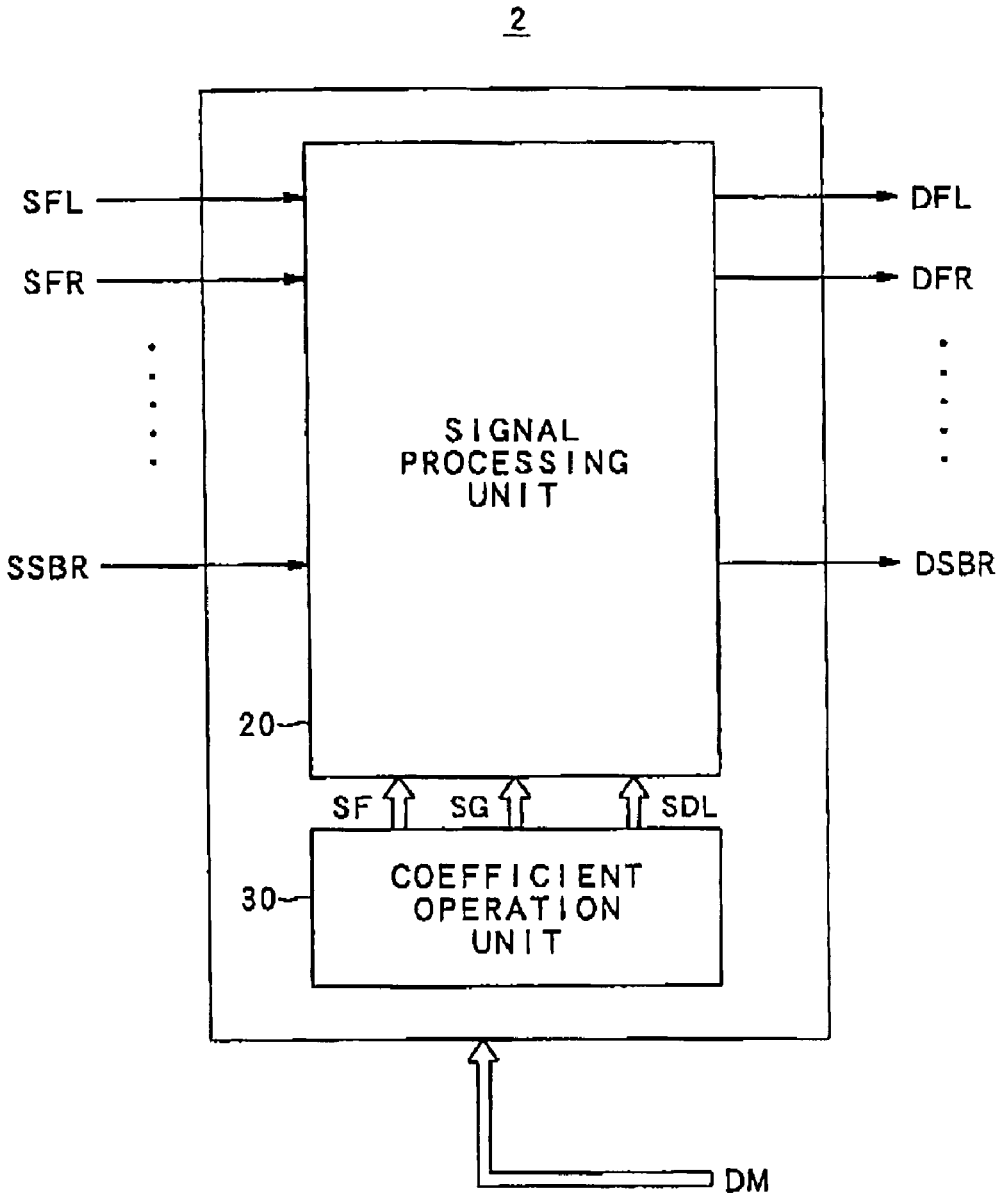
FIG. 4 is a block diagram showing an internal configuration of a signal processing circuit shown in FIG. 3.

The signal processing circuit 2 may have a digital signal processor (DSP), and roughly includes a signal processing unit 20 and a coefficient operation unit 30 as shown in FIG. 4. The signal processing unit 20 receives the multi-channel digital audio signals from the sound source 1 reproducing sound from various sound sources such as a CD, a DVD or else, and performs the frequency characteristics correction, the level correction and the delay characteristic correction for each channel to output the digital output signals DFL to DSBR.

The coefficient operation unit 30 receives the signal collected by the microphone 8 as the digital collected sound data DM, generates the coefficient signals SF1 to SF8, SG1 to SG8, SDL1 to SDL8 for the frequency characteristics correction, the level correction and the delay characteristics correction, and supplies them to the signal processing unit 20. The signal processing unit 20 appropriately performs the frequency characteristics correction, the level correction and the delay characteristics correction based on the collected sound data DM from the microphone 8, and the speakers 6 output optimum sounds.

Figure 5:
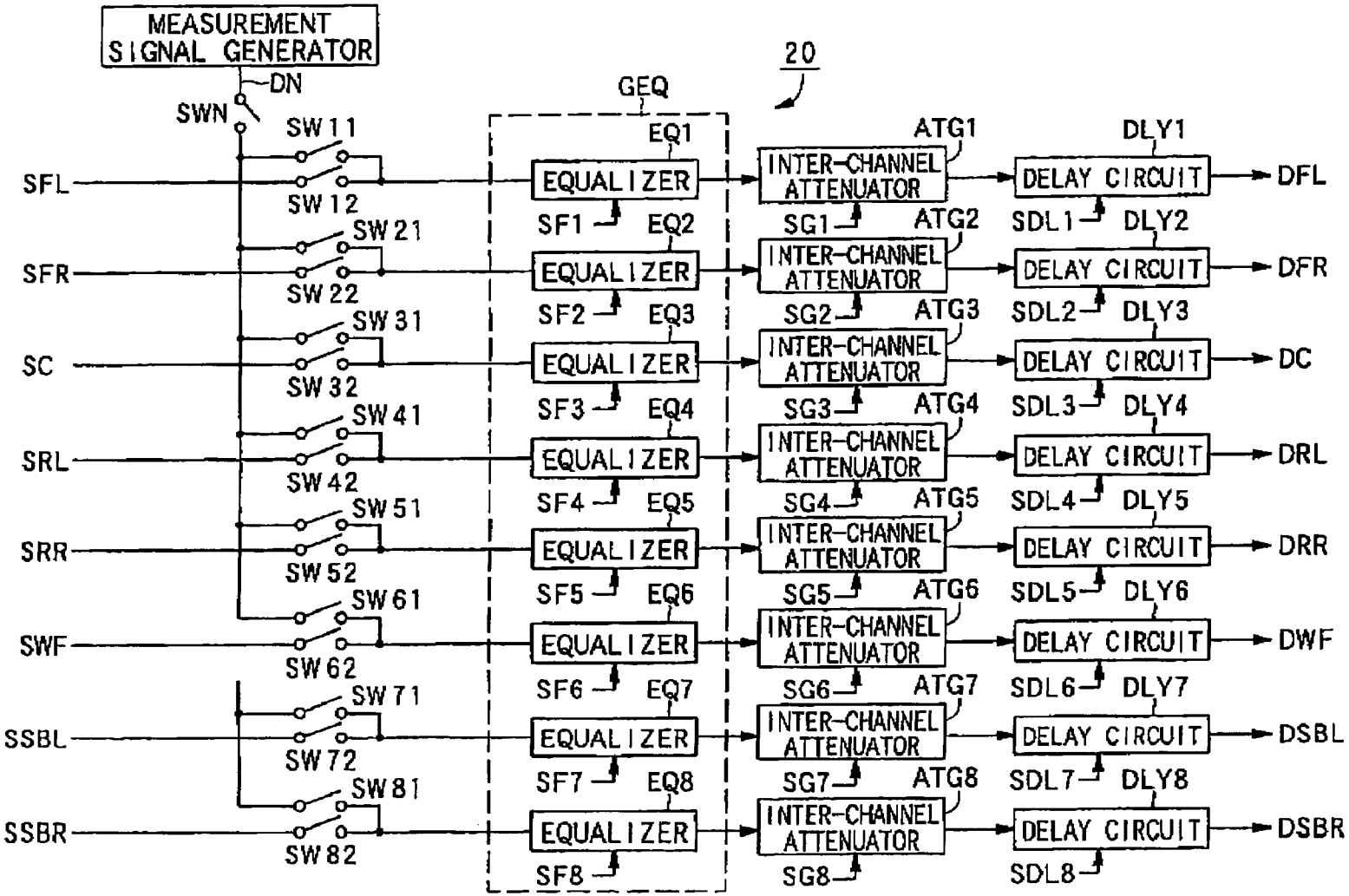
FIG. 5 is a block diagram showing a configuration of a signal processing unit shown in FIG. 4.
Figure 6:
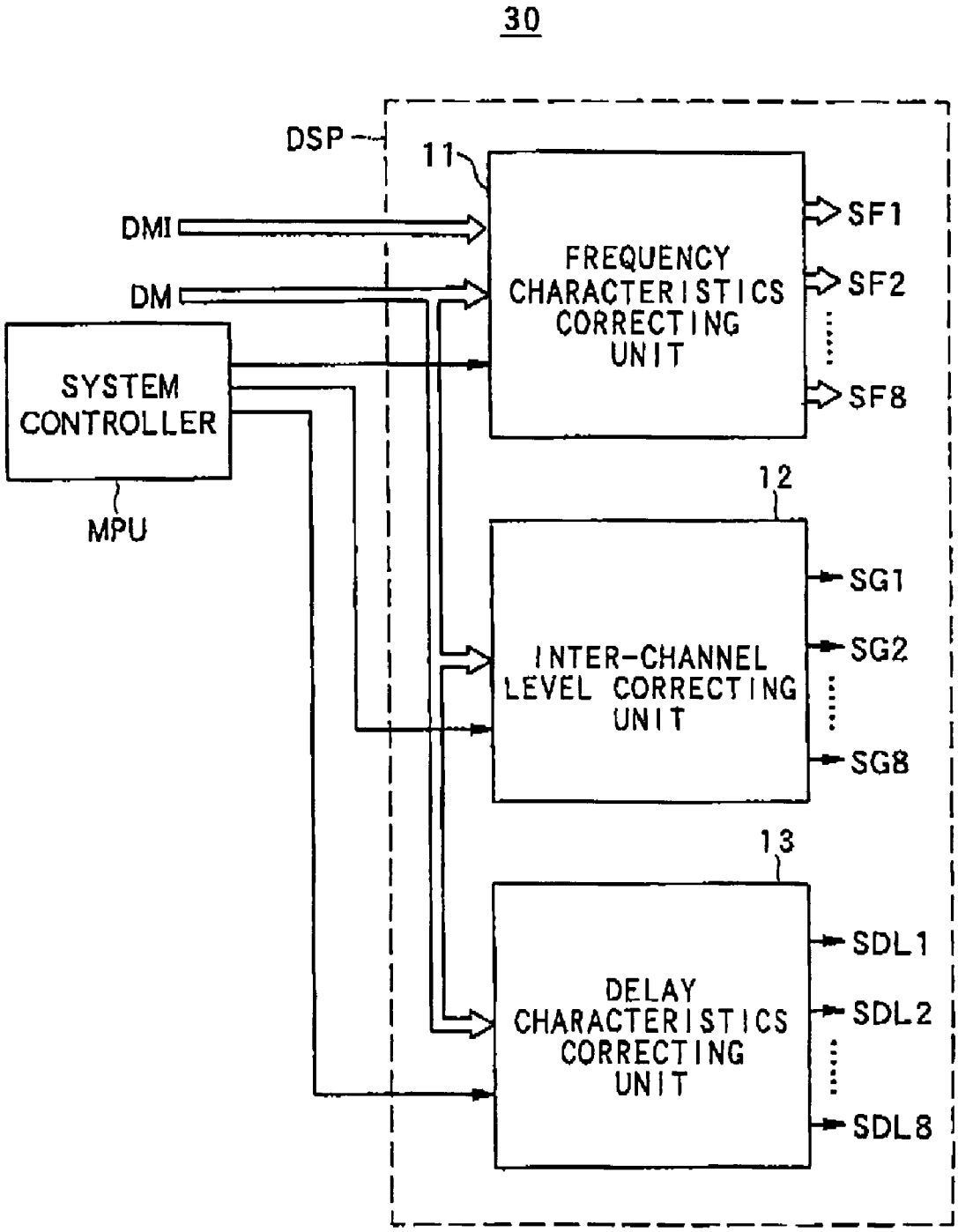
FIG. 6 is a block diagram showing a configuration of a coefficient operation unit shown in FIG. 2.

As shown in FIG. 5, the signal processing unit 20 includes a graphic equalizer GEQ, inter-channel attenuators ATG1 to ATG8, and delay circuits DLY1 to DLY8. On the other hand, the coefficient operation unit 30 includes, as shown in FIG. 6, a system controller MPU, a frequency characteristics correcting unit 11, an inter-channel level correcting unit 12 and a delay characteristics correcting unit 13. The frequency characteristics correcting unit 11, the inter-channel level correcting unit 12 and the delay characteristics correcting unit 13 constitute DSP.

The frequency characteristics correcting unit 11 adjusts the frequency characteristics of the equalizers EQ1 to EQ8 corresponding to the respective channels of the graphic equalizer GEQ. The inter-channel level correcting unit 12 controls the attenuation factors of the inter-channel attenuators ATG1 to ATG8, and the delay characteristics correcting unit 13 controls the delay times of the delay circuits DLY1 to DLY8. Thus, the sound field is appropriately corrected.

The equalizers EQ1 to EQ5, EQ7 and EQ8 of the respective channels are configured to perform the frequency characteristics correction for each frequency band. Namely, the audio frequency band is divided into 9 frequency bands (each of the center frequencies are f1 to f9), for example, and the coefficient of the equalizer EQ is determined for each frequency band to correct frequency characteristics. It is noted that the equalizer EQ6 is configured to control the frequency characteristic of low-frequency band.

The audio system 100 has two operation modes, i.e., an automatic sound field correcting mode and a sound source signal reproducing mode. The automatic sound field correcting mode is an adjustment mode, performed prior to the signal reproduction from the sound source 1, wherein the automatic sound field correction is performed for the environment that the audio system 100 is placed. Thereafter, the sound signal from the sound source 1 such as a CD player is reproduced in the sound source signal reproduction mode. An explanation below mainly relates to the correction operation in the automatic sound field correcting mode.

With reference to FIG. 5, the switch element SW12 for switching ON and OFF the input digital audio signal. SFL from the sound source 1 and the switch element SW11 for switching ON and OFF the input measurement signal DN from the measurement signal generator 3 are connected to the equalizer EQ1 of the FL-channel, and the switch element SW11 is connected to the measurement signal generator 3 via the switch element SWN.

The switch elements SW11, SW12 and SWN are controlled by the system controller MPU configured by microprocessor shown in FIG. 6. When the sound source signal is reproduced, the switch element SW12 is turned ON, and the switch elements SW11 and SWN are turned OFF. On the other hand, when the sound field is corrected, the switch element SW12 is turned OFF and the switch elements SW11 and SWN are turned ON.

The inter-channel attenuator ATG1 is connected to the output terminal of the equalizer EQ1, and the delay circuit DLY1 is connected to the output terminal of the inter-channel attenuator ATG1. The output DFL of the delay circuit DLY1 is supplied to the D/A converter 4FL shown in FIG. 3.

The other channels are configured in the same manner, and switch elements SW21 to SW81 corresponding to the switch element SW11 and the switch elements SW22 to SW82 corresponding to the switch element SW12 are provided. In addition, the equalizers EQ2 to EQ8, the inter-channel attenuators ATG2 to ATG8 and the delay circuits DLY2 to DLY8 are provided, and the outputs DFR to DSBR from the delay circuits DLY2 to DLY8 are supplied to the D/A converters 4FR to 4SBR, respectively, shown in FIG. 3.

Further, the inter-channel attenuators ATG1 to ATG8 vary the attenuation factors within the range equal to or smaller than 0 dB in accordance with the adjustment signals SG1 to SG8 supplied from the inter-channel level correcting unit 12. The delay circuits DLY1 to DLY8 control the delay times of the input signal in accordance with the adjustment signals SDL1 to SDL8 from the phase characteristics correcting unit 13.

Figure 7A:
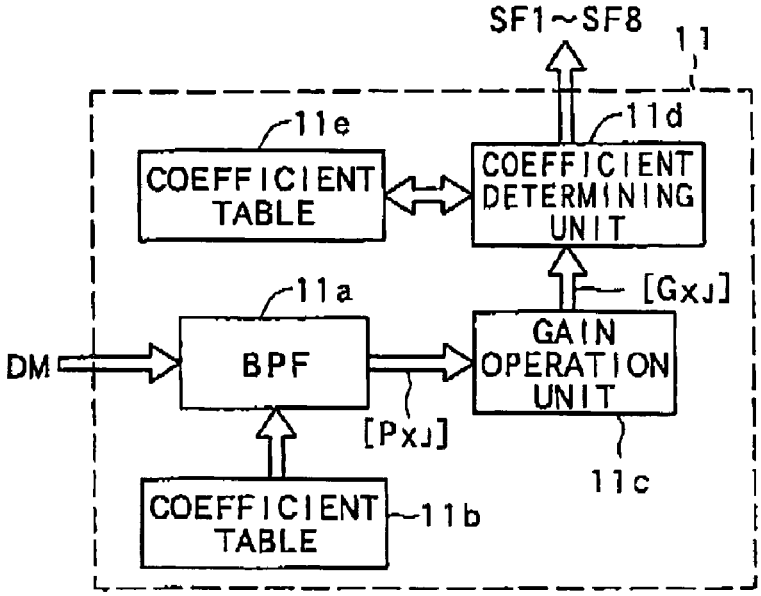
FIGS. 7A to 7C are block diagrams showing configurations of a frequency characteristics correcting unit, an inter-channel level correcting unit and a delay characteristics correcting unit shown in FIG. 6.

The frequency characteristics correcting unit 11 has a function to adjust the frequency characteristic of each channel to have a desired characteristic. As shown in FIG. 7A, the frequency characteristics correcting unit 11 includes a band-pass filter 11*a*, a coefficient table 11*b*, a gain operation unit 11*c*, a coefficient determining unit 11*d* and a coefficient table 11*e*.

The band-pass filter 11*a* is configured by a plurality of narrow-band digital filters passing 9 frequency bands set to the equalizers EQ1 to EQ8. The band-pass filter 11*a* discriminates 9 frequency bands each including center frequency f1 to f9 from the collected sound data DM from the A/D converter 10, and supplies the data [P×J] indicating the level of each frequency band to the gain operation unit 11*c*. The frequency discriminating characteristic of the band-pass filter 11*a* is determined based on the filter coefficient data stored, in advance, in the coefficient table 11*b*.

The gain operation unit 11*c* operates the gains of the equalizers EQ1 to EQ8 for the respective frequency bands at the time of the automatic sound field correction based on the data [P×J] indicating the level of each frequency band, and supplies the gain data [G×J] thus operated to the coefficient determining unit 11*d*. Namely, the gain operation unit 11*c* applies the data [P×J] to the transfer functions of the equalizers EQ1 to EQ8 known in advance to calculate the gains of the equalizers EQ1 to EQ8 for the respective frequency bands in the reverse manner.

The coefficient determining unit 11*d* generates the filter coefficient adjustment signals SF1 to SF8, used to adjust the frequency characteristics of the equalizers EQ1 to EQ8, under the control of the system controller MPU shown in FIG. 6. It is noted that the coefficient determining unit 11*d* is configured to generate the filter coefficient adjustment signals SF1 to SF8 in accordance with the conditions instructed by the listener, at the time of the sound field correction. In a case where the listener does not instruct the sound field correction condition and the normal sound field correction condition preset in the sound field correcting system is used, the coefficient determining unit 11*d* reads out the filter coefficient data, used to adjust the frequency characteristics of the equalizers EQ1 to EQ8, from the coefficient table 11*e* by using the gain data [G×J] for the respective frequency bands supplied from the gain operation unit 11*c*, and adjusts the frequency characteristics of the equalizers EQ1 to EQ8 based on the filter coefficient adjustment signals SF1 to SF8 of the filter coefficient data.

In other words, the coefficient table 11*e* stores the filter coefficient data for adjusting the frequency characteristics of the equalizers EQ1 to EQ8, in advance, in a form of a look-up table. The coefficient determining unit 11*d* reads out the filter coefficient data corresponding to the gain data [G×J], and supplies the filter coefficient data thus read out to the respective equalizers EQ1 to EQ8 as the filter coefficient adjustment signals SF1 to SF8. Thus, the frequency characteristics are controlled for the respective channels.

Next, the description will be given of the inter-channel level correcting unit 12. The inter-channel level correcting unit 12 has a role to adjust the sound pressure levels of the sound signals of the respective channels to be equal. Specifically, the inter-channel level correcting unit 12 receives the collected sound data DM obtained when the respective speakers 6FL to 6SBR are individually activated by the measurement signal (pink noise) DN outputted from the measurement signal generator 3, and measures the levels of the reproduced sounds from the respective speakers at the listening position RV based on the collected sound data DM.

Figure 7B:
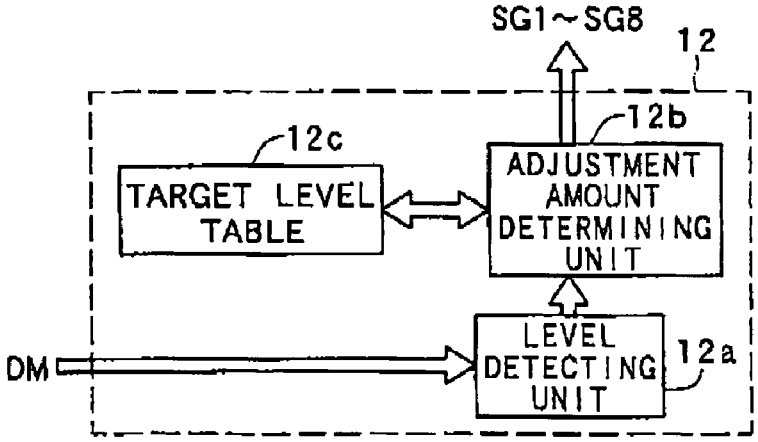

FIG. 7B schematically shows the configuration of the inter-channel level correcting unit 12. The collected sound data DM outputted by the A/D converter 10 is supplied to a level detecting unit 12*a*. It is noted that the inter-channel level correcting unit 12 uniformly attenuates the signal levels of the respective channels for all frequency bands, and hence the frequency band division is not necessary. Therefore, the inter-channel level correcting unit 12 does not include any band-pass filter as shown in the frequency characteristics correcting unit 11 in FIG. 7A.

The level detecting unit 12*a* detects the level of the collected sound data DM, and carries out gain control so that the output audio signal levels for all channels become equal to each other. Specifically, the level detecting unit 12*a* generates the level adjustment amount indicating the difference between the level of the collected sound data thus detected and a reference level, and supplies it to an adjustment amount determining unit 12*b*. The adjustment amount determining unit 12*b* generates the gain adjustment signals SG1 to SG8 corresponding to the level adjustment amount received from the level detecting unit 12*a*, and supplies the gain adjustment signals SG1 to SG8 to the respective inter-channel attenuators ATG1 to ATG8. The inter-channel attenuators ATG1 to ATG8 adjust the attenuation factors of the audio signals of the respective channels in accordance with the gain adjustment signals SG1 to SG8. By adjusting the attenuation factors of the inter-channel level correcting unit 12, the level adjustment (gain adjustment) for the respective channels is performed so that the output audio signal level of the respective channels become equal to each other.

The delay characteristics correcting unit 13 adjusts the signal delay resulting from the difference in distance between the positions of the respective speakers and the listening position RV. Namely, the delay characteristics correcting unit 13 has a role to prevent that the output signals from the speakers 6 to be listened simultaneously by the listener reach the listening position RV at different times. Therefore, the delay characteristics correcting unit 13 measures the delay characteristics of the respective channels based on the collected sound data DM which is obtained when the speakers 6 are individually activated by the measurement signal DN outputted from the measurement signal generator 3, and corrects the phase characteristics of the sound field space based on the measurement result.

Specifically, by turning over the switches SW11 to SW82 shown in FIG. 5 one after another, the measurement signal DN generated by the measurement signal generator 3 is output from the speakers 6 for each channel, and the output sound is collected by the microphone 8 to generate the correspondent collected sound data DM. Assuming that the measurement signal is a pulse signal such as an impulse, the difference between the time when the speaker 6 outputs the pulse measurement signal and the time when the microphone 8 receives the correspondent pulse signal is proportional to the distance between the speaker 6 of each channel and the listening position RV. Therefore, the difference in distance of the speakers 6 of the respective channels and the listening position RV may be absorbed by setting the delay time of all channels to the delay time of the channel having maximum delay time. Thus, the delay time between the signals generated by the speakers 6 of the respective channels become equal to each other, and the sound outputted from the multiple speakers 6 and coincident with each other on the time axis simultaneously reach the listening position RV.

Figure 7C:
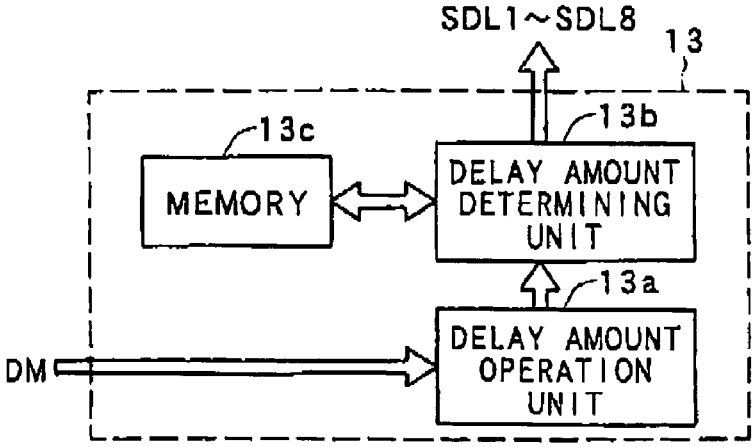

FIG. 7C shows the configuration of the delay characteristics correcting unit 13. A delay amount operation unit 13*a* receives the collected sound data DM, and operates the signal delay amount (time) resulting from the sound field environment for the respective channels on the basis of the pulse delay amount between the pulse measurement signal and the collected sound data DM. A delay amount determining unit 13*b* receives the signal delay amounts for the respective channels from the delay amount operation unit 13*a*, and temporarily stores them in a memory 13*c*. When the signal delay amounts for all channels are operated and temporarily stored in the memory 13*c*, the delay amount determining unit 13*b* determines the adjustment amounts of the respective channels such that the reproduced signal of the channel having the largest signal delay amount reaches the listening position RV simultaneously with the reproduced sounds of other channels, and supplies the adjustment signals SDL1 to SDL8 to the delay circuits DLY1 to DLY8 of the respective channels. The delay circuits DLY1 to DLY8 adjust the delay amount in accordance with the adjustment signals SDL1 to SDL8, respectively. Thus, the delay characteristics for the respective channels are adjusted. It is noted that, while the above example assumed that the measurement signal for adjusting the delay time is the pulse signal, this invention is not limited to this, and other measurement signal may be used.

In the present invention, the delay amount operation unit 13*a* includes each component shown in FIG. 1B. The background noise measurement unit 253 measures the largest level of the background noise in the background noise measurement period Tm including the in-device delay time Tp, and the threshold determining unit 254 determines the threshold TH based on the largest level. The differentiating circuit 251 differentiates a reproduction signal of each channel to calculate the absolute value. The comparator 252 does not execute the comparison processing in the no-response period, i.e., in the period until the passing of the in-device delay time Tp from the output time of the measurement signal, and compares the absolute value of the reproduction signal with the threshold TH after the passing of the no-response period to determine the signal delay amount Tp. This process is executed for each channel.

(II) Automatic Sound Field Correction

Next, the description will be given of the operation of the automatic sound field correction by the automatic sound field correcting system employing the configuration described above.

First, as the environment in which the audio system 100 is used, the listener positions the multiple speakers 6FL to 6SBR in a listening room 7 as shown in FIG. 8, and connects the speakers 6FL to 6SBR to the audio system 100 as shown in FIG. 3. When the listener manipulates a remote controller (not shown) of the audio system 100 to instruct the start of the automatic sound field correction, the system controller MPU executes the automatic sound field correction process in response to the instruction.

Figure 9:
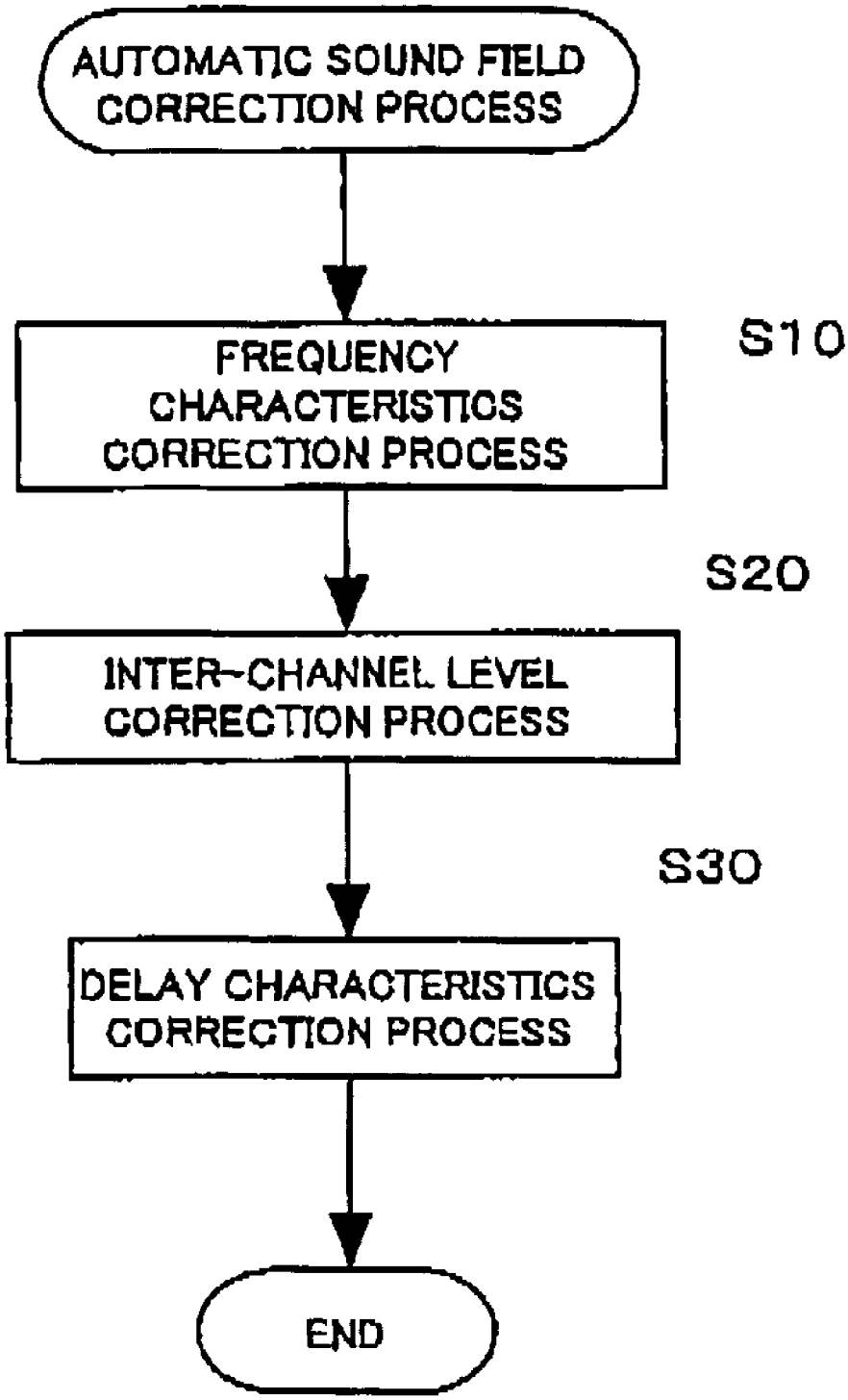
FIG. 9 is a flow chart showing a main routine of an automatic sound field correction process.

Next, the basic principle of the automatic sound field correction according to the present invention will be described. As described above, the processes executed in the automatic sound field correction are the frequency characteristic correction of each channel, the correction of the sound pressure level and the delay characteristics correction. The description will schematically be given of the automatic sound field correction process with reference to a flow chart shown in FIG. 9.

First, in step S10, the frequency characteristics correcting unit 11 adjusts the frequency characteristics of the equalizers EQ1 to EQ8. Next, in an inter-channel level correction process in step S20, the inter-channel level correcting unit 12 adjusts the attenuation factors of the inter-channel attenuators ATG1 to ATG8 provided for the respective channels. Next, in a delay characteristics correction process in step S30, the delay characteristics correcting unit 13 adjusts the delay time of the delay circuits DLY1 to DLY8 of all the channels. The automatic sound field correction according to the present invention is performed in this order.

Figure 10:
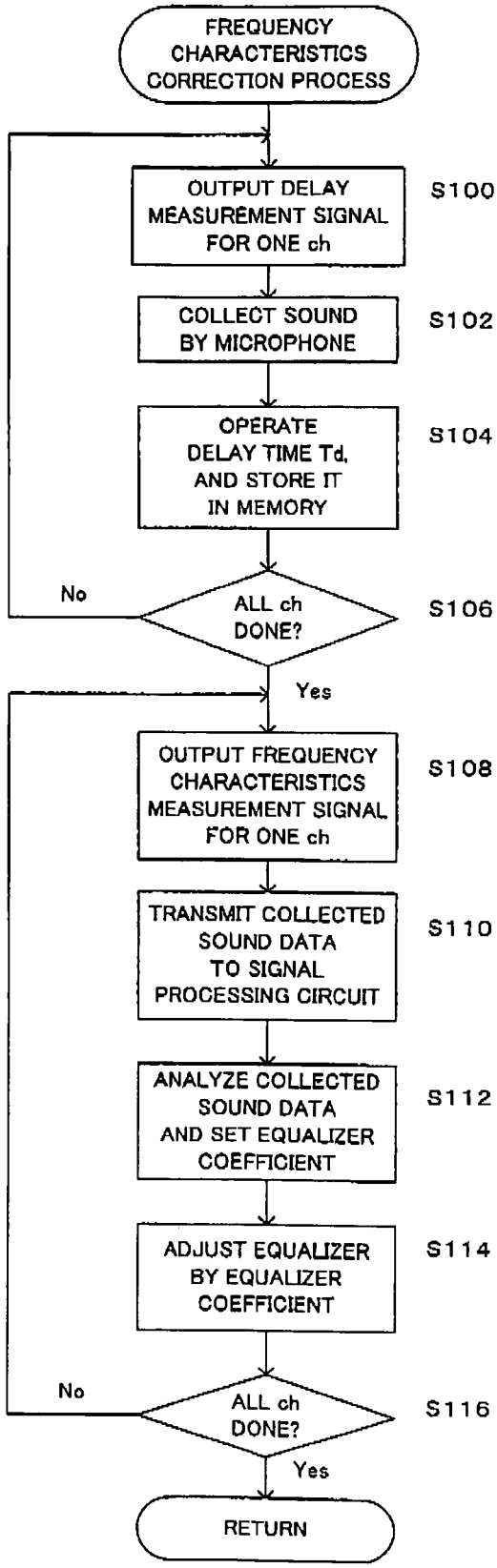
FIG. 10 is a flow chart showing a frequency characteristics correction process.

Next, the operation for each process will be explained in order with reference to FIG. 10. FIG. 10 is a flow chart of the frequency characteristics correction process according to the present embodiment. It is noted that the frequency characteristics correction process shown in FIG. 10 is for performing the delay measurement for each channel prior to the frequency characteristics correction process for each channel. The delay measurement is the process of measuring a delay time from the output of the measurement signal by the signal processing circuit 2 until arrival of the correspondent collected sound data at the signal processing circuit 2, i.e., the process of pre-measuring the delay time Td for each channel. In FIG. 10, a procedure in steps S100 to S106 corresponds to the delay measurement process, and a procedure in steps S108 to S115 corresponds to an actual frequency characteristics correction process.

In FIG. 10, the signal processing circuit 2 outputs the pulse delay measurement signal in one of the plural channels at first, and the signal is outputted from the speaker 6 as the measurement signal sound (step S100). The measurement signal sound is collected by the microphone 8, and the collected sound data DM is supplied to the signal processing circuit 2 (step 102). The frequency characteristics correcting unit 11 in the signal processing circuit 2 operates the delay time Td, and stores it in its memory and the like (step S104). When the process of all the steps S100 to S104 is executed with respect to all the channels (step S106; Yes), the delay times Td of all the channels are stored in the memory. Thus, the delay time measurement is completed.

Next, the frequency characteristics correction is executed for each channel. Namely, the signal processing circuit 2 outputs the frequency characteristics measurement signal such as the pink noise for one channel, and the signal is outputted from the speaker 6 as the measurement signal sound (step S108). The measurement signal sound is collected by the microphone 8, and the collected sound data is obtained in the frequency characteristics correcting unit 11 in the signal processing circuit 2 (step S110). The gain operation unit 11*c* in the frequency characteristics correcting unit 11 analyzes the collected sound data, and the coefficient determining unit 11*d* sets the equalizer coefficient (step S112). On the basis of the equalizer coefficient, the equalizer is adjusted (step S114). Thereby, based on the collected sound data, the frequency characteristics correction is completed for one channel. The process is executed for all the channels (step S116; Yes), and the frequency characteristics correction process is completed.

Figure 11:
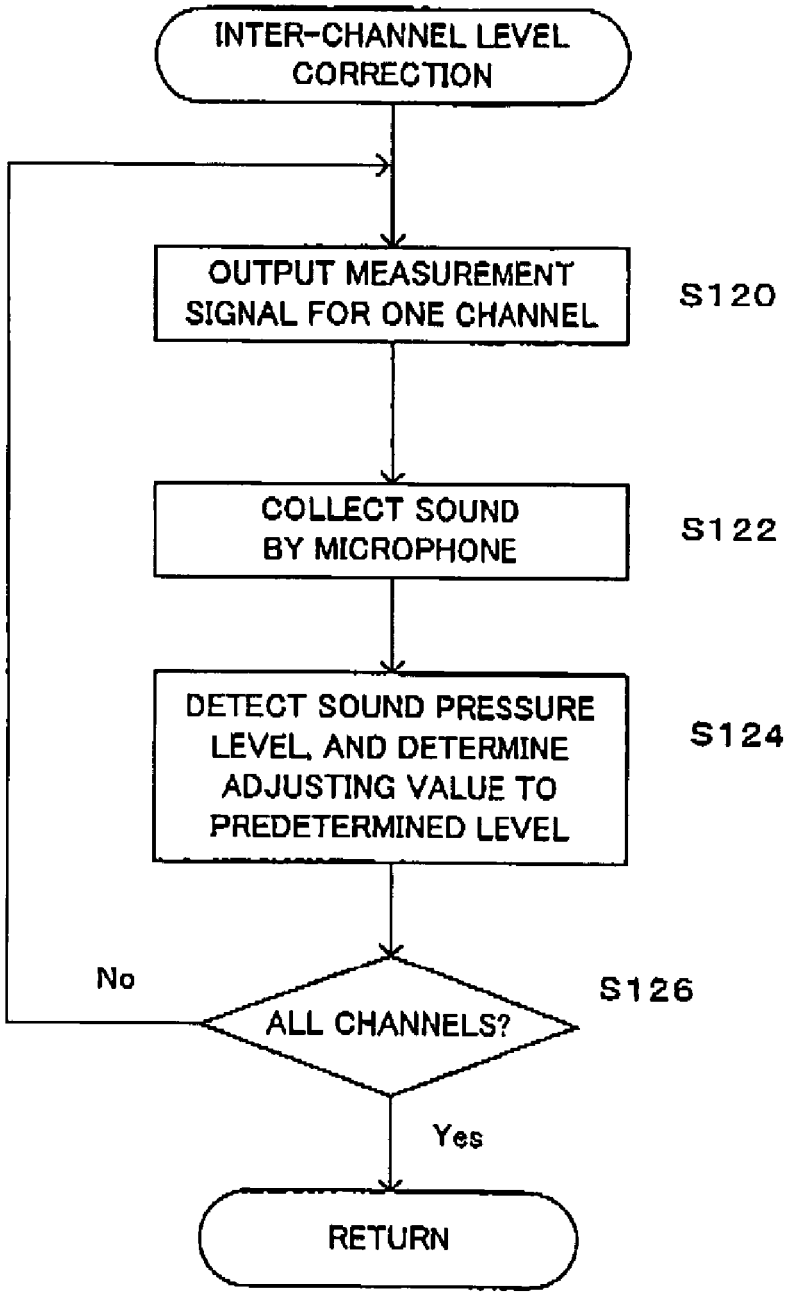
FIG. 11 is a flow chart showing an inter-channel level correction process.

Next, an inter-channel level correction process in step S20 is performed. The inter-channel level correction process is performed in accordance with the flow chart shown in FIG. 11. In the inter-channel level correction process, the correction is performed by maintaining a state in which the frequency characteristic of the graphic equalizer GEQ set by the previous frequency characteristics correction process is adjusted by the above-mentioned frequency characteristics correction process.

In the signal processing unit 20 shown in FIG. 5, by making the switch SW11 in the ON state and the switch SW12 in the OFF state in the first place, the measurement signal DN (pink noise) is supplied to the one channel (e.g., FL channel), and the measurement signal DN is outputted from the speaker 6FL (step S120) The microphone 8 collects the signal, and the collected sound data DM is supplied to the inter-channel level correcting unit 12 in the coefficient operation unit 30 via the amplifier 9 and the A/D converter 10 (step S122). In the inter-channel level correcting unit 12, the level detecting unit 12*a* detects the sound pressure level of the collected sound data DM, and transmits it to the adjustment amount determining unit 12*b*. The adjustment amount determining unit 12*b* generates the adjusting signal SG1 of the inter-channel attenuator ATG1 so that the detected sound pressure level corresponds to the predetermined sound pressure level which is set to a target level table 12*c* in advance, and supplies the adjusting signal SG1 to the inter-channel attenuator ATG1 (step S124). In that way, the correction is performed so that the sound pressure level of the one channel corresponds to the predetermined sound pressure level The process is executed for each channel in order, and when the level correction is completed for all the channels (step S126; Yes), the process returns to the main routine in FIG. 9.

Figure 12:
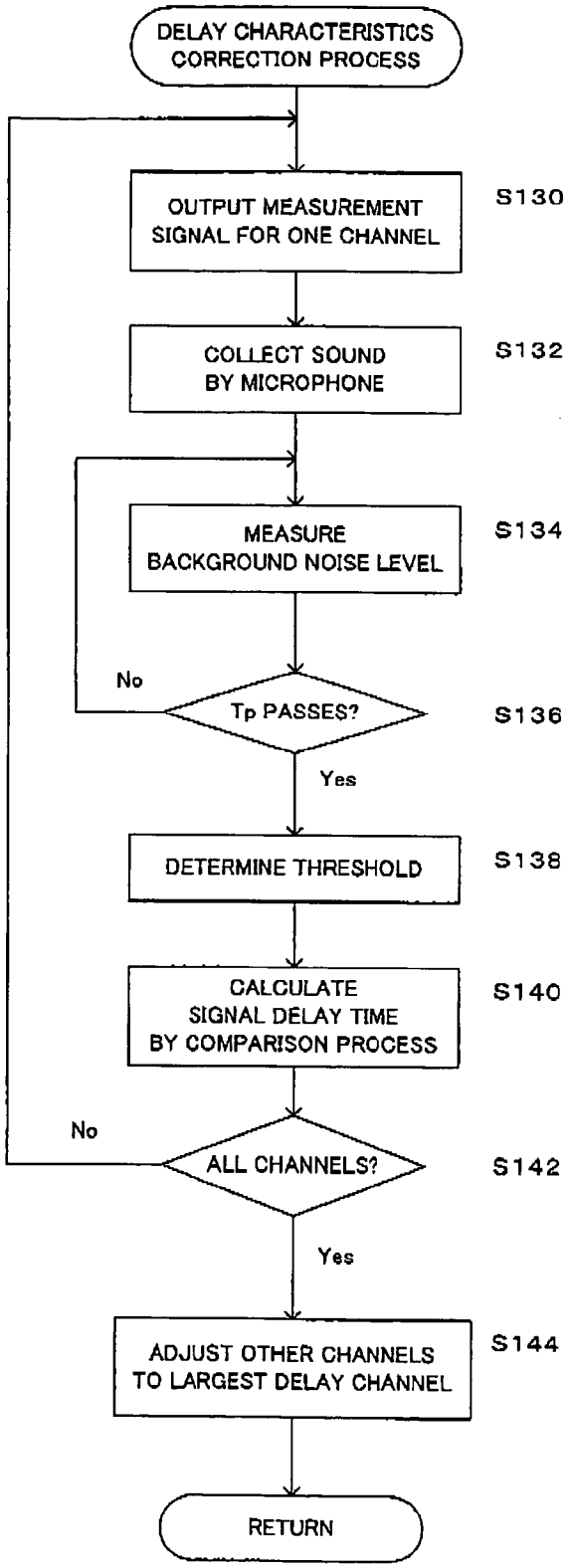
FIG. 12 is a flow chart showing a delay correction process.

Next, the delay characteristics correction process in step S30 is executed in accordance with a flow chart shown in FIG. 12. First, by making the switch SW11 in the ON state and the switch SW12 in the OFF state for the one channel (e.g., FL channel), the measurement signal DN is outputted from the speaker 6 (step S130). Next, the outputted measurement signal DN is collected by the microphone 8, and the collected sound data DM is inputted to the delay characteristics correcting unit 13 in the coefficient operation unit 30 (step S132).

As described above, the delay amount operation unit 13*a* includes each component shown in FIG. 1B. Inside the delay amount operation unit 13*a*, first the background noise measurement unit 253 measures the background noise level (step S134). The measurement is performed until the background noise measurement period Tm ends, i.e., during the period of the predetermined in-device delay time Tp from the output time of the measurement signal. The time period is also set to the no-response time, and the comparison processing by the comparator 252 is not executed during the period.

When the in-device delay time Tp passes (step S136; Yes), the no-response period ends. Therefore, the threshold determining unit 254 determines the threshold (step S138). The comparator 252 executes the comparison processing and calculates the signal delay amount Td (step S140).

The process is executed for all the other channels. When the process is completed for all the channels (step S142; Yes), the memory 13*c* stores the delay amount of all the channels. Next, based on storage contents of the memory 13*c*, the coefficient operation unit 13*b* determines the coefficients of the delay circuits DLY1 to DLY8 of the respective channels so that the signals of all the other channels simultaneously reach the listening position RV with respect to the channel having the largest delay amount in all the channels, and supplies them to the respective delay circuits DLYs (step S138). Thereby, the delay characteristics correction is completed.

In that way, the frequency characteristic, the inter-channel level and the delay characteristic are corrected, and the automatic sound field correction is completed.

[Modification]

In the above-mentioned embodiment, the signal process according to the present invention is realized by the signal processing circuit. Instead, if the identical signal process is designed as a program to be executed on a computer, the signal process can be realized on the computer. In that case, the program is supplied by a recording medium, such as a CD-ROM and a DVD, or by communication by using a network and the like. As the computer, a personal computer and the like can be used, and an audio interface corresponding to plural channels, plural speakers and microphones and the like are connected to the computer as peripheral devices. By executing the above-mentioned program on the personal computer, the measurement signal is generated by using the sound source provided inside or outside the personal computer, and is outputted via the audio interface and the speaker to be collected by using the microphone. Thereby, the above-mentioned sound characteristic measuring device and automatic sound field correcting device can be realized by using the computer.

The invention may be embodied on other specific forms without departing from the spirit or essential characteristics thereof. The present embodiments therefore to be considered in all respects as illustrative and not restrictive, the scope of the invention being indicated by the appended claims rather than by the foregoing description and all changes which come within the meaning an range of equivalency of the claims are therefore intended to embraced therein.

The entire disclosure of Japanese Patent Application No. 2003-389027 filed on Nov. 19, 2003 including the specification, claims, drawings and summary is incorporated herein by reference in its entirety.

What is claimed is:

1. A signal delay time measurement device which measures a signal delay time in a sound space, comprising:

a measurement signal output unit which outputs a measurement signal;

a signal sound output unit which outputs a measurement signal sound corresponding to the measurement signal to the sound space;

a response detecting unit which outputs a response signal indicating a response of the sound space to the measurement signal sound; and a delay time calculating unit which performs a comparison between the response signal and a predetermined threshold to calculate the signal delay time, wherein the delay time calculating unit does not perform the comparison in a no-response period in which the response signal has not reached the delay time calculating unit yet.

2. The signal delay time measurement device according to claim 1, further comprising a threshold determining unit which measures a background noise in the sound space during a background noise measurement period and determines the predetermined threshold based on a measurement result before each signal delay time is calculated, wherein the background noise measurement period includes the no-response period.

3. The signal delay time measurement device according to claim 1, wherein the no-response period corresponds to an in-device delay time which is caused by a processing of the measurement signal and the response signal in the signal delay time measurement device.

4. The signal delay time measurement device according to claim 3, further comprising a storage unit which stores the in-device delay time as a fixed value, wherein the no-response period is set to a period of the in-device delay time from an output timing of the measurement signal.

5. A signal delay time measurement device which measures a signal delay time in a sound space, comprising:

a measurement signal output unit which outputs a measurement signal;

a signal sound output unit which outputs a measurement signal sound corresponding to the measurement signal to the sound space;

a response detecting unit which outputs a response signal indicating a response of the sound space to the measurement signal sound;

a delay time calculating unit which performs a comparison between the response signal and a predetermined threshold to calculate the signal delay time; and a threshold determining unit which measures a background noise in the sound space during a background noise measurement period and determines the predetermined threshold based on a measurement result before each signal delay time is calculated, wherein the background noise measurement period includes a no-response period in which the response signal has not reached the delay time calculating unit yet.

6. The signal delay time measurement device according to claim 5, wherein the background noise measurement period includes a predetermined period before the measurement signal output unit outputs the measurement signal.

7. A computer program product in a computer-readable medium executed on a computer, the computer program product making the computer function as a signal delay time measurement device comprising:

a measurement signal output unit which outputs a measurement signal;

a signal output unit which outputs a measurement signal sound corresponding to the measurement signal to the sound space;

a response detecting unit which outputs a response signal indicating a response of the sound space to the measurement signal sound; and a delay time calculating unit which performs a comparison between the response signal and a predetermined threshold to calculate a signal delay time in the sound space, wherein the delay time calculating unit does not perform the comparison in a no-response period in which the response signal has not reached the delay time calculating unit yet.

8. A computer program product in a computer-readable medium executed on a computer, the computer program product making the computer function as a delay time measurement device comprising:

a measurement signal output unit which outputs a measurement signal;

a signal sound output unit which outputs a measurement signal sound corresponding to the measurement signal to a sound space;

a response detecting unit which outputs a response signal indicating a response of the sound space to the measurement signal sound;

a delay time calculating unit which performs a comparison between the response signal and a predetermined threshold to calculate a signal delay time in the sound space; and a threshold determining unit which measures a background noise in the sound space in a background noise measurement period and determines the predetermined threshold based on a measurement result before each signal delay time is calculated, wherein the background measurement period includes a no-response period in which the response signal has not reached the delay time calculating unit yet.

9. A signal delay time measurement method which measures a signal delay time in a sound space, comprising:

a measurement signal output process which outputs a measurement signal;

a signal sound output process which outputs a measurement signal sound corresponding to the measurement signal to the sound space;

a response detecting process which outputs a response signal indicating a response of the sound space to the measurement signal sound; and a delay time calculating process which performs a comparison between the response signal and a predetermined threshold to calculate the signal delay time by a delay time calculating unit, wherein the delay time calculating process does not perform the comparison in a no-response period in which the response signal has not reached the delay time calculating unit yet.

10. A signal delay time measurement method which measures a signal delay time in a sound space, comprising:

a measurement signal output process which outputs a measurement signal;

a signal sound output process which outputs a measurement signal sound corresponding to the measurement signal to the sound space;

a response detecting process which outputs a response signal indicating a response of the sound space to the measurement signal sound;

a delay time calculating process which performs a comparison between the response signal and a predetermined threshold to calculate the signal delay time by a delay time calculating unit; and a threshold determining process which measures a background noise in the sound space in a background noise measurement period and determines the predetermined threshold based on a measurement result before each signal delay time is calculated, wherein the background noise measurement period includes a no-response period in which the response signal has not reached the delay time calculating unit yet.

* * * * *